US009243467B2

(12) United States Patent
Hales

(10) Patent No.: US 9,243,467 B2
(45) Date of Patent: Jan. 26, 2016

(54) SAFETY SYSTEM FOR OIL AND GAS DRILLING OPERATIONS

(75) Inventor: John Hudson Hales, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 766 days.

(21) Appl. No.: 13/177,327

(22) Filed: Jul. 6, 2011

(65) Prior Publication Data

US 2013/0008670 A1 Jan. 10, 2013

(51) Int. Cl.
*E21B 29/08* (2006.01)
*E21B 33/10* (2006.01)

(52) U.S. Cl.
CPC ..... *E21B 29/08* (2013.01); *E21B 33/10* (2013.01)

(58) Field of Classification Search
USPC ..... 166/297, 376, 55, 55.1, 55.2, 55.6; 251/1.1, 1.2, 1.3
See application file for complete search history.

(56) References Cited

U.S. PATENT DOCUMENTS 1,834,063 A * 12/1931 King et al. ..... 137/460
1,932,570 A * 10/1933 Black ..... 166/86.3
3,870,098 A * 3/1975 Houston ..... 166/55.1
4,160,478 A * 7/1979 Calhoun et al. ..... 166/55.1
4,193,455 A * 3/1980 Steddum et al. ..... 166/359
4,305,565 A 12/1981 Abbe
4,372,378 A * 2/1983 Powers, Jr. ..... 166/57
4,446,920 A * 5/1984 Woytek et al. ..... 166/297
4,520,994 A 6/1985 DeWald
4,553,598 A * 11/1985 Meek et al. ..... 166/317
4,588,035 A 5/1986 Van Gils et al.
5,551,665 A * 9/1996 Noack et al. ..... 251/58
5,819,853 A 10/1998 Patel
6,102,626 A * 8/2000 Milberger ..... 405/216
6,125,937 A * 10/2000 Longbottom et al. ..... 166/313
6,167,974 B1 1/2001 Webb
6,626,244 B2 9/2003 Powers
2008/0289878 A1 11/2008 Livingstone

* cited by examiner

*Primary Examiner* — David Andrews
*Assistant Examiner* — Ronald Runyan
(74) *Attorney, Agent, or Firm* — Haynes and Boone, LLP

(57) ABSTRACT

A sub-surface safety system for hydrocarbon drilling operations is provided and includes at least one casing within a wellbore that extends into a first portion of a formation from the surface of the formation. A shut-in device is positioned in the casing so as to be below the surface of the formation. The well shut-in device defines a device passageway and is operable to sever a drill string extending through the device passageway and form a barrier in the device passageway that restricts wellbore fluids below the barrier from migrating up the casing to the surface.

24 Claims, 8 Drawing Sheets

SAFETY SYSTEM FOR OIL AND GAS DRILLING OPERATIONS

BACKGROUND

In oilfield operations, safety systems typically are employed to manage unplanned well events, such as blow outs. For the well-drilling phase of such operations, conventional safety systems may include blow-out preventers (BOPs). BOPs are typically positioned at or above the surface of the formation, directly below the rig floor or at or near the mud line or ground level. BOP configurations such as this have a number of drawbacks.

Positioning a BOP at or above the surface of the formation exposes the BOP to potential damage from external forces that could render the BOP inoperable. For example, weather events can cause damage to a BOP positioned at or above the surface of the formation. Furthermore, human-operated machines or device such as vehicles, cranes, anchors or the like can damage a BOP located at or above the surface of the formation.

Thus, what is needed is an improved safety system for the drilling phase of oil and gas wells.

BRIEF DESCRIPTION OF THE DRAWINGS

A more complete understanding of the present disclosure and advantages thereof may be acquired by referring to the following description taken in conjunction with the accompanying figures, wherein.

DETAILED DESCRIPTION

In the detailed description of the embodiments, like numerals are employed to designate like parts throughout. Various items of equipment, such as pipes, valves, pumps, fasteners, fittings, etc., may be omitted to simplify the description. However, those skilled in the art will realize that such conventional equipment may be employed as desired.

The present disclosure provides a system and method for shutting in a well during the drilling phase of oilfield operations using a shut-in device that is not subject to damage from exposure to weather events, human operations or the like. During the drilling phase of these operations, a well shut-in device is positioned below the surface of the formation in at least one of the wellbore casings before the wellbore depth is extended to reach a portion of the formation that includes a pressurized target substance, such as, for example, oil, natural gas, and/or other hydrocarbons. With the well shut-in device positioned below the surface of the formation, it is not subject to exposure damage from weather events or most human operations. Once the well shut-in device is positioned in at least one of the wellbore casings, drilling is continued into the target portion of the formation that includes the pressurized target substance. If at any time after the well shut-in device is positioned in at least one of the casings, e.g., when the hole is being drilled into the target portion of the formation that includes the pressurized target substance, an emergency occurs that results in an unplanned well event such as a well blow out, the well shut-in device may be actuated to provide a barrier that restricts the pressurized target fluid from moving through a casing passageway to shut off the well.

Figure 1:
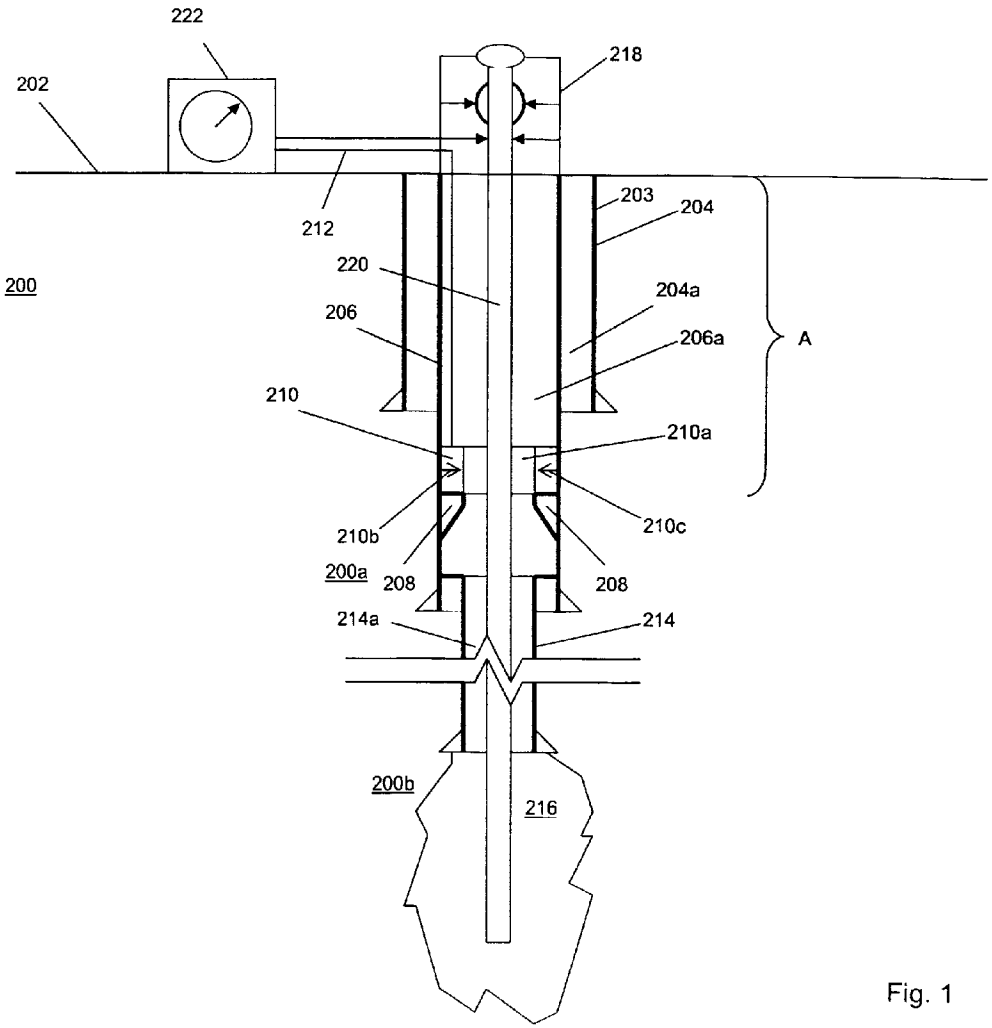
FIG. 1 is a cross-sectional view illustrating an embodiment of a production casing extending from the intermediate casing and into the formation, a well shut-in device coupled to the intermediate casing and located below a surface of the formation, and a drilling member positioned in a casing passageway.

Referring now to FIG. 1, a formation 200 that includes a surface 202 is illustrated. Extending into the formation 200 from surface 202 is a wellbore 203 into which a surface casing 204 is cemented. The surface casing 204 defines a first casing passageway 204*a* that extends along the length of the surface casing 204.

The formation 200 includes a first portion 200*a* adjacent the surface 202 that typically does not include a target fluid under enough pressure such that the target fluid will enter the wellbore 203 and a second portion 200*b* that does include a target fluid that is under enough pressure such that the target fluid will enter the wellbore 203. As is known in the art, various methods may be used to determine a depth into the formation 200 at which a wellbore 203 may be drilled such that target fluid adjacent the wellbore 203 will not be under enough pressure to enter the wellbore 203. An intermediate casing 206 is positioned in the first casing passageway 204*a* and the wellbore 203 is cemented into place, as illustrated in FIG. 1. Preferably, the portion of the wellbore 203 in which the intermediate casing 206 is positioned and cemented is still in the first portion 200*a* of the formation 200 that does not include a pressurized target fluid.

The intermediate casing 206 defines a second casing passageway 206*a* that extends along the length of the intermediate casing 206. A shut-in device 210 is positioned within intermediate casing 206 at a point along its length a distance "A" below the surface 202 of formation 200. While shut-in device 201 may be secured in any manner known in the art, in one embodiment, shut-in device is secured in place by a support 208 that extends from the intermediate casing 206 and into the second casing passageway 206*a*. In an embodiment, the support 208 may include multiple support members that extend from an inner wall of the intermediate casing 206, or may be a flange, ring, or shoulder formed or otherwise disposed on an inner wall of the intermediate casing 206, and/or a variety of other support structures known in the art. In an embodiment, the distance A is approximately 200 to 800 feet. The shut-in device 210 defines a shut-in passageway 210*a* that is positioned in a substantially concentric orientation with the second casing passageway 206*a*. In the illustrated embodiment, the shut-in device 210 includes a shear ram having a plurality of shearing members 210*b* and 210*c* that are positioned on opposite sides of the shut-in passageway 210*a*. An actuation line 212 is coupled to the shut-in device 210 and extends through the second casing passageway 206*a* and out of wellbore 203. In an embodiment, the shut-in device 210 may be coupled to the intermediate casing 206 (e.g., through the support 208 or other known fasteners) prior to the intermediate casing 206 being positioned and cemented in wellbore 203. In an embodiment, the shut-in device 210 may be positioned in the intermediate casing 206 subsequent to the intermediate casing 206 being positioned and cemented into wellbore 203.

With continued reference to FIG. 1 a drilling member 220 such as a drill string is shown. A blow out preventer (BOP) 218 may be positioned at or above the surface 202 of the formation 200, and the drilling member 220 extends through BOP 218 in the typical manner known in the art. As shown, the drilling member 220 extends through first casing 204, second casing 206 and shut-in device 210. With the drilling member 220 passing through shut-in device 210, drilling member 220 is located in shut-in passageway 210*a* defined by the shut-in device 210 such that the drilling member 220 is positioned adjacent each of the shearing members 210*b* and 210*c*. The actuation line 212 coupled to the shut-in device 210 is also coupled to an actuator 222. Actuator 222 may also be coupled to the BOP 218. In an embodiment, the drilling member 220 may include a drilling tool, a pipe, and/or a variety of other drilling members known in the art.

In another embodiment, one or more casings that may include a production casing 214 are positioned and cemented in wellbore 203 below the intermediate casing 206. The production casing 214 defines a third casing passageway 214*a* that extends along the length of the production casing 214 and to a wellbore section 216 located adjacent the second portion 206*b* of the formation 200. At least one of the surface casing 204, the intermediate casing 206, and the production casing 214 defines a casing passageway that extends between the second portion 200*b* of the formation 200 and the surface 202 of the formation 200. For example, in the illustrated embodiment, the third casing passageway 214*a* extends between the section 216 of the hole and the second casing passageway 206*a*, and the second casing passageway 206*a* extends to the surface 202 of the formation 200.

Figure 2:
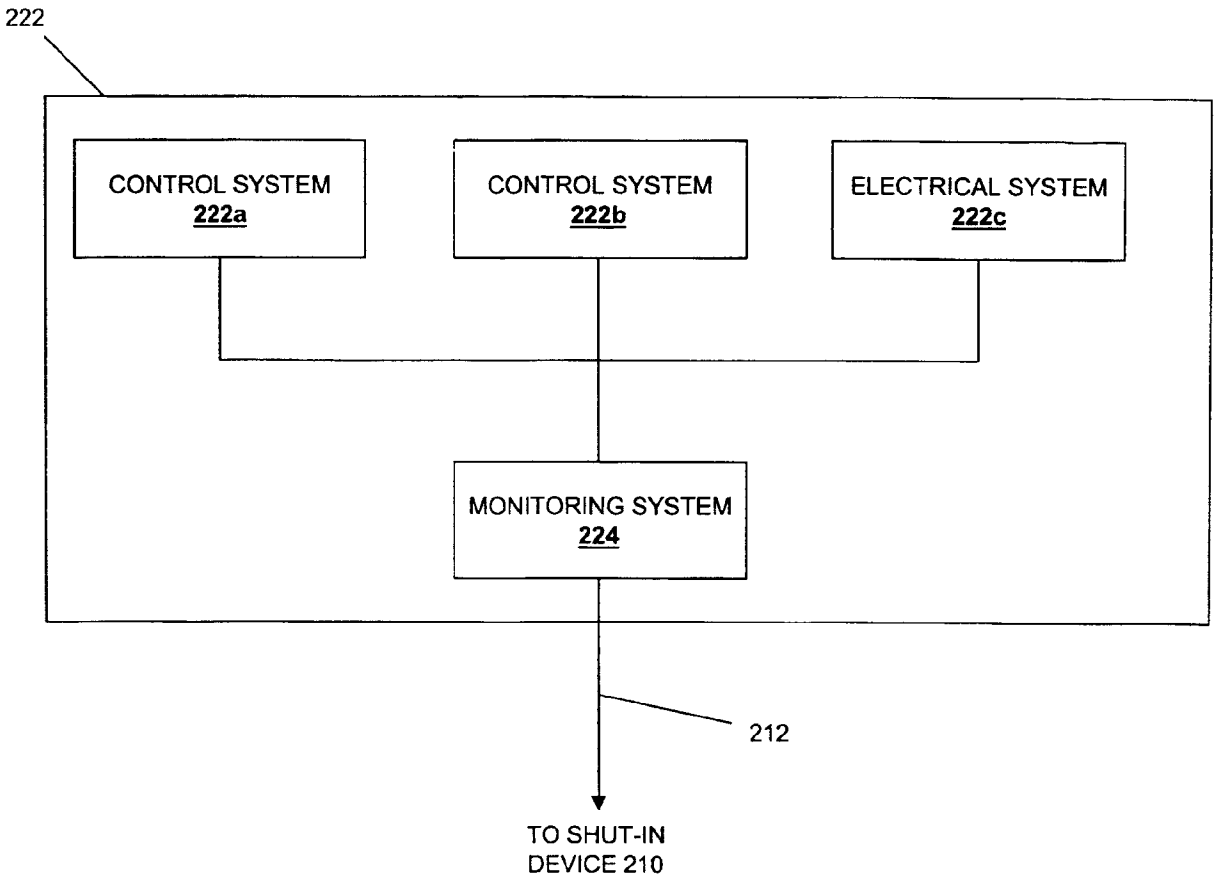
FIG. 2 is a schematic view illustrating an embodiment of an actuator that is coupled to the well shut-in device of FIG. 1.

Referring now to FIG. 2, in an embodiment, the actuator 222 includes a control system 222*a*, a control system 222*b*, and an electrical system 222*c*, each of which are coupled to a monitoring system 224 that is coupled to the shut-in device 210 through the actuator line 212. In an embodiment, the actuator 222 provides a positive force or pressure to the shearing members 210*b* and 210*c* in order to maintain the shearing members 210*b* and 210*c* in an "open" position (e.g., retracted from the shut-in passageway 210*a*.) For example, the actuator 222 may provide the positive force or pressure through a positive power system that may include a mechanical system, a hydraulic system, an electrical system, combinations thereof, and/or a variety of other positive power systems know in the art. In the embodiment illustrated in FIG. 2, the actuator 222 includes a redundant system that includes the first control system 222*a* providing a positive force or pressure to maintain the shearing members 210*b* and 210*c* in the open position, the second control system 222*b* that provides a positive force or pressure to maintain the shearing members 210*b* and 210*c* in the open position, the electrical system 222*c* that is coupled to a "dump" valve, and the monitoring system 224 that monitors each of the first control system 222*a*, the second control system 222*b*, and the electrical system 222*c* to determine when to actuate the shut-in device 210, as described in further detail below.

In an embodiment, the monitoring system 224 monitors each of the first control system 222*a*, the second control system 222*b*, and the electrical system 222*c* in order to determine whether to actuate the shut-in device 210. For example, the monitoring system 224 may not actuate the shut-in device 210 unless each of the first control system 222*a*, the second control system 222*b*, and the electrical system 222*c* has been activated. As discussed above, each of the first control system 222*a* and the second control system 222*b* may provide a positive force or pressure to the shearing members 210*b* and 210*c* in order to maintain the shearing members 210*b* and 210*c* in an open position. The first control system 222*a* and the second control system 222*b* may be "activated" when the positive pressure they provide to the shearing members 210*b* and 210*c* is released (e.g., automatically or by an operator operating a pressure release member.) Furthermore, the electrical system 222*c* coupled to the dump valve may not allow the dump valve to operate unless power is shut down. The electrical system 222*c* may be activated when power is shut down (e.g., automatically or by an operator shutting down power.) Thus, in an embodiment, the monitoring system 224 monitors each of the first control system 222*a*, the second control system 222*b*, and the electrical system 222*c* for activation, and if the pressure is released in the first control system 222*a* and the second control system 222*b* while the power is shut down in the electrical system 222*c*, the positive force or pressure provided to the shearing members 210*b* and 210*c* is removed. The actuator 222 provides a redundant system in that if the monitoring system 224 does not determine that each of the first control system 222*a*, the second control system 222*b*, and the electrical system 222*c* are activated, the positive force or pressure provided to the shearing members 210*b* and 210*c* is not removed. While one example of a control system for actuating the shut-in device 210 has been described, one of skill in the art will recognize that a variety of other control systems will fall within the scope of the present disclosure.

Figure 3:
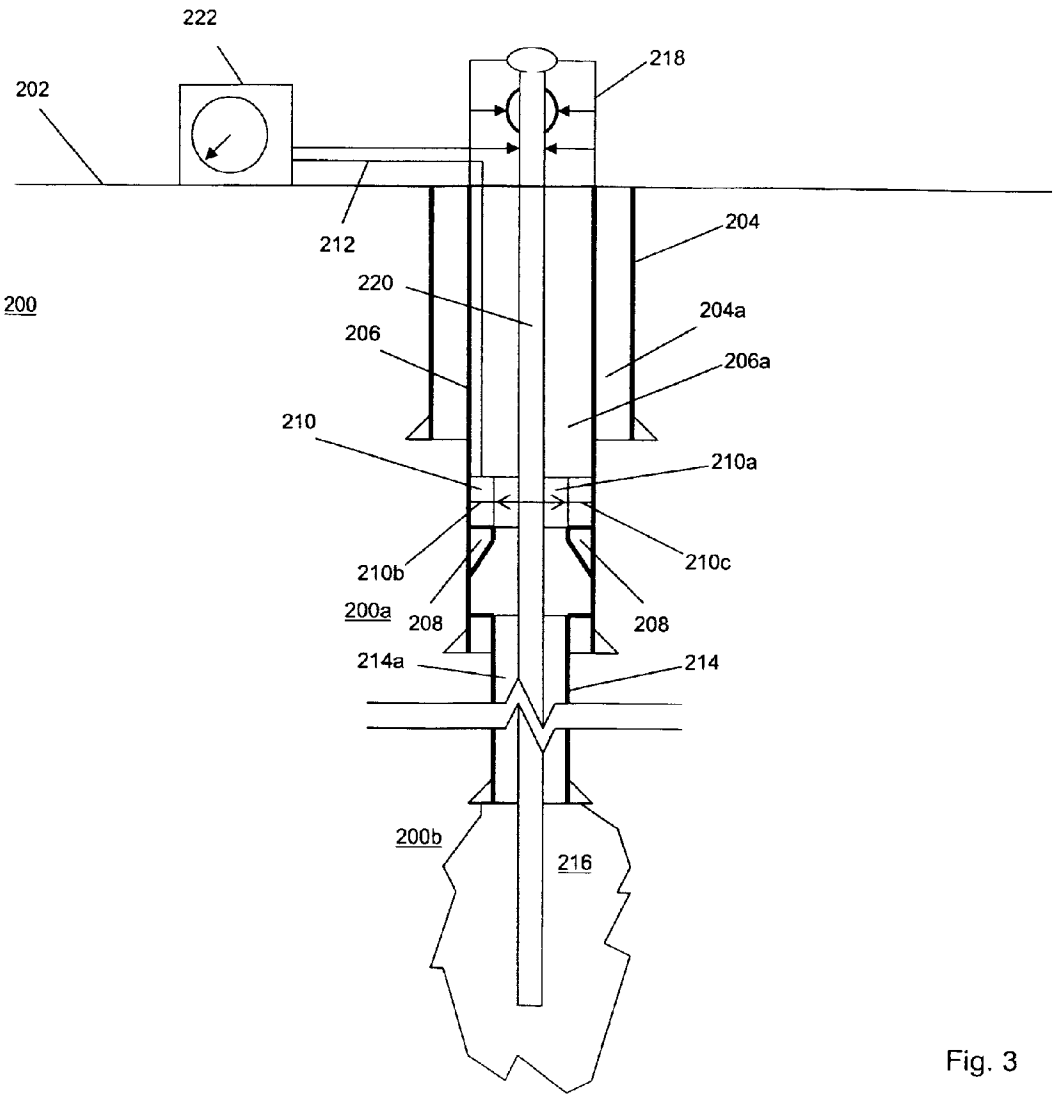
FIG. 3 is a cross-sectional view illustrating an embodiment of the well shut-in device of FIG. 1 actuated to provide a barrier in the casing passageway.

Upon the release of the positive pressure maintaining shearing members 210*b* and 210*c* in an "open" position, the shearing members 210*b* and 210*c* extend into the shut-in passageway 210*a*, as illustrated in FIG. 3. The shearing members 210*b* and 210*c*, upon extending into the shut-in passageway 210*a*, shear drilling member 220 at the point adjacent shut-in passageway 210*a*. With the shearing members 210*b* and 210*c* positioned in the shut-in passageway 210*a*, shearing members 210 effectively seal off shut-in passageway 201, forming a barrier that restricts the pressurized target substance located in the second portion 200*b* of the formation 200 from migrating through casing passageway defined by the casings (e.g., the second casing passageway 206*a* defined by the second casing 206.) In an embodiment, after the shearing members 210 shear the drilling member 220, a packer may be used to seal off the shut-in passageway 201 by forming a barrier that restricts the pressurized target substance located in the second portion 200*b* of the formation 200 from migrating through casing passageway defined by the casings.

Thus, a drilling phase shut-in device is provided that is positioned below the surface of the formation being drilled such that the shut-in device is substantially immune to damage from weather events or human operated machines or devices operated at or above the surface (or mudline) as the case may be.

Figure 4:
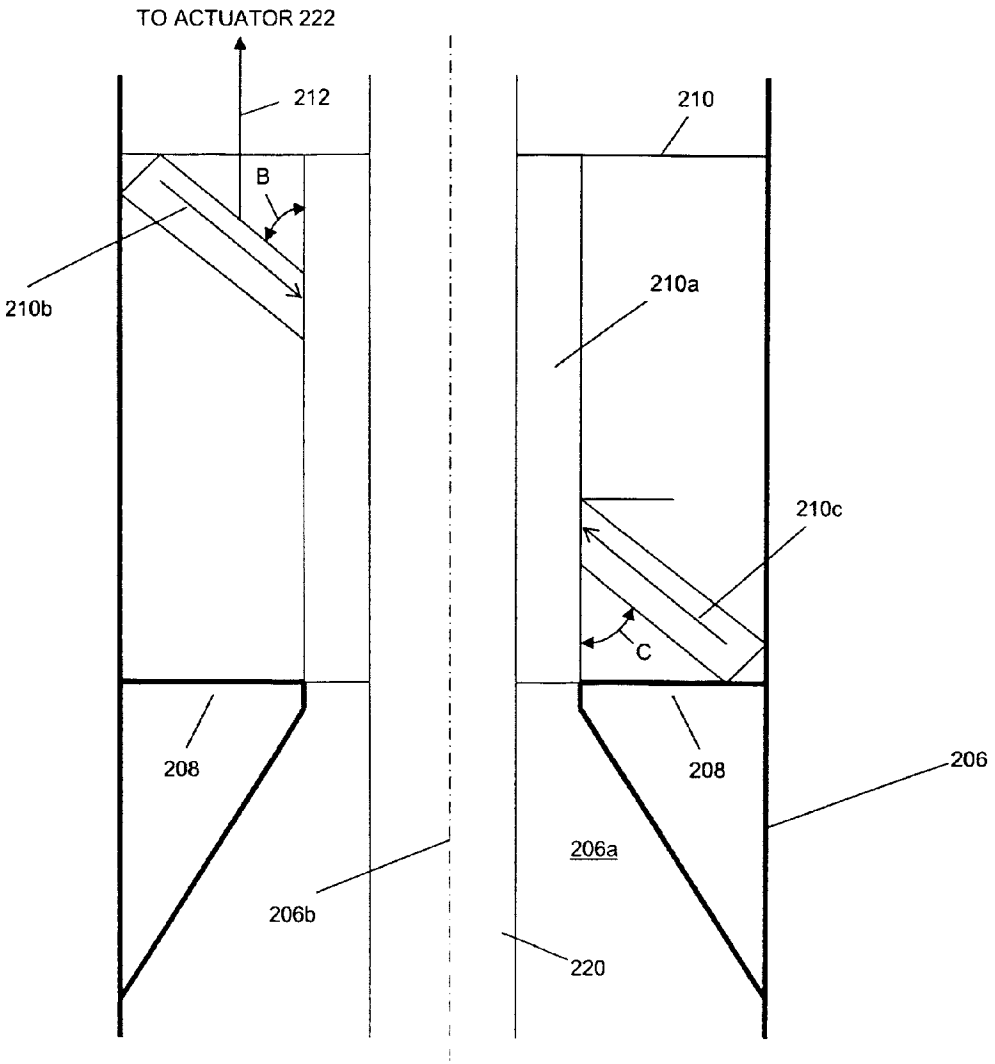
FIG. 4 is a cross-sectional view illustrating an embodiment of a well shut-in device with shear rams that are oriented at an angle to a longitudinal axis of a casing.
Figure 5:
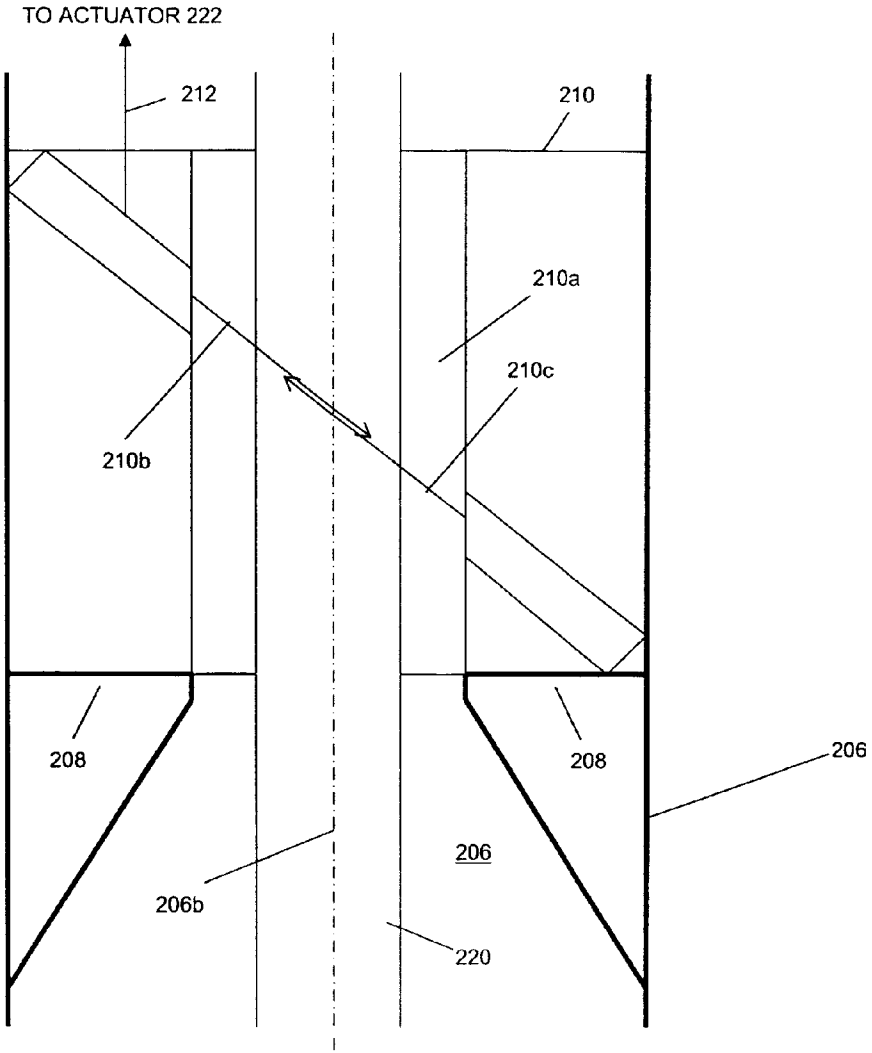
FIG. 5 is a cross-sectional view illustrating an embodiment of the well shut-in device of FIG. 4 actuated to provide a barrier in the casing passageway.

Referring now to FIGS. 4 and 5, an embodiment of a shut-in device 210 is illustrated in more detail. FIG. 4 illustrates shut-in device 210 in an "open" position, while FIG. 5 illustrates shut-in device in a "closed" position. In any event, the intermediate casing 206 includes a longitudinal axis 206*b* that extends along the length of the intermediate casing 206 and is substantially axially located in the second casing passageway 206*a*. The shut-in device 210 includes the shearing member 210*b* oriented at an angle B relative to the longitudinal axis 206*b* of the intermediate casing 206 and the shearing member 210*c* oriented at an angle C relative to the longitudinal axis 206*b* of the intermediate casing 206. In an embodiment, the angle B is between 0 and 90 degrees. In an embodiment, the angle C is between 0 and 90 degrees. The angles B and C may be influenced by a variety of factors. For example, as the casing gets larger, the angle B and/or C should get smaller. Also, the larger the angle B and/or C, the more material that will need to be sheared. Furthermore, during a blow-out, shearing will be easier with the flow than against it.

In operation, the shearing members 210*b* and 210*c* may be actuated substantially as described above to shear the drilling member 220 and provide a barrier in the shut-in passageway 210*a* and the casing passageway, as illustrated in FIG. 5. One of skill in the art will recognize that, during the drilling phase of the oilfield operations, the casing passageways defined in the casings provide a limited volume. By orienting the shearing members 210*b* and 210*c* at the angle B and C, respectively, the shearing members 210*b* and 210*c* may perform the function of providing a barrier in the shut-in passageway 210*a* and the casing passageway using the limited volume available in the casing passageway. Furthermore, orienting the shearing members 210*b* and 210*c* at the angle B and C, respectively, allows conventional casings to be retrofitted using conventional shear rams for the shut-in device such that the system and method described above may be provided and performed at a reduced cost.

Figure 6:
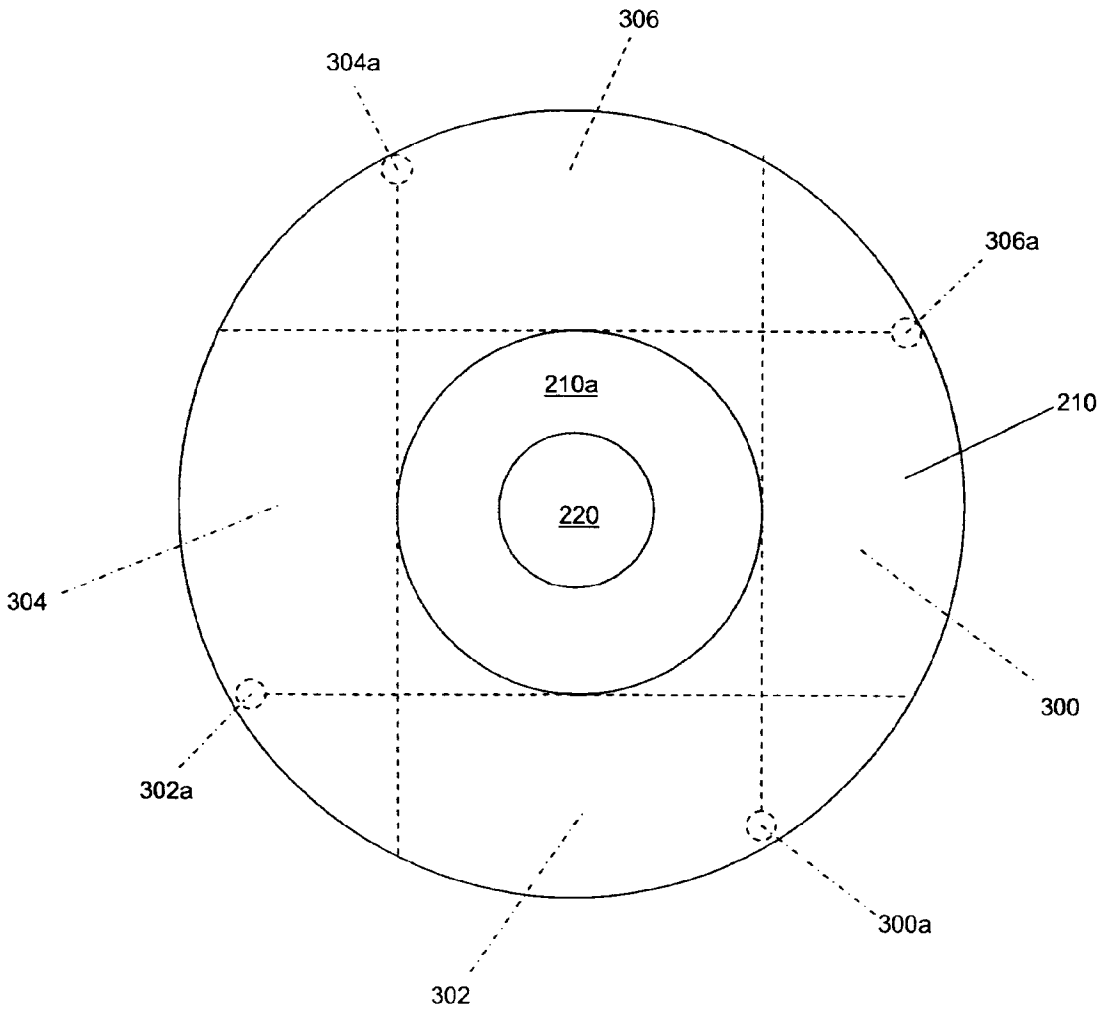
FIG. 6 is a top view illustrating an embodiment of a well shut-in device with members that pivot relative to the well shut-in device.
Figure 7:
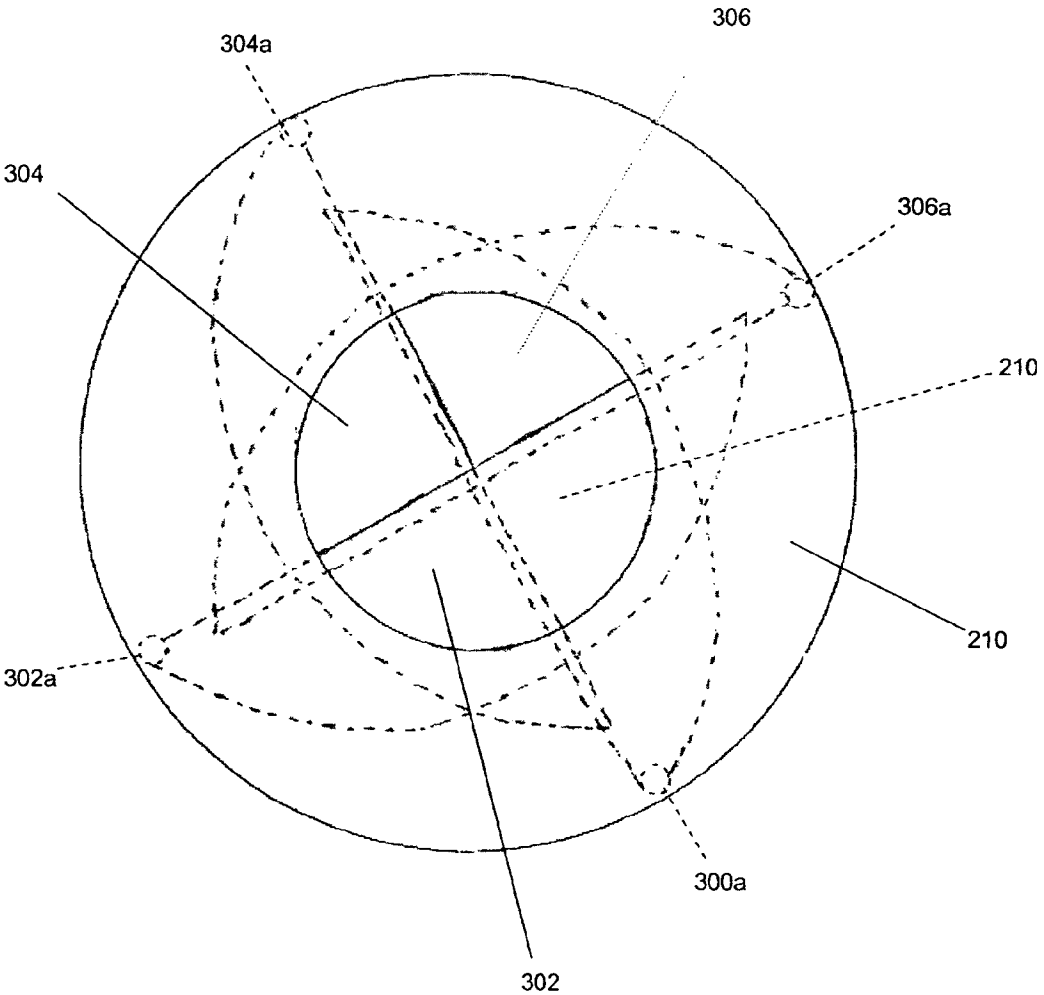
FIG. 7 is a top view illustrating an embodiment of the well shut-in device of FIG. 6 actuated to provide a barrier in the casing passageway.

Referring now to FIGS. 6 and 7, an embodiment of a shut-in device 210 is illustrated. The shut-in device 210 includes a plurality of shearing members 300, 302, 304, and 306, each of which are pivotally mounted utilizing pivotal couplings 300*a*, 302*a*, 304*a*, and 306*a* that form part of the shut-in device 210. In operation, the shearing members 300, 302, 304, and 306 may be actuated using the actuator 222, in a substantially similar manner as the shearing members 210*b* and 210*c* described above, to shear the drilling member 220 and provide a barrier in the shut-in passageway 210*a* and the casing passageway, as illustrated in FIG. 7. However, rather than being actuated along a linear path such as shearing members 210*b* and 210*c*, the shearing members 300, 302, 304, and 306 are pivotally actuated about their respective pivotal couplings 300*a*, 302*a*, 304*a*, and 306*a*. One of skill in the art will recognize that, during the drilling phase of the oilfield operations, the casing passageways defined in the casings provide a limited volume. By providing the pivotal shearing members 300, 302, 304, and 306 as described, the shut-in members 300, 302, 304, and 306 may perform the function of providing a barrier in the shut-in passageway 210*a* and the casing passageway using the limited volume available in the casing passageway.

In another embodiment, the well shut-in device 210 may include a chemical cutting agent and a sealing agent. In operation, in response to an unplanned event such as a well blow-out, the shut-in device 210 releases the chemical cutting agent into the shut-in passageway 210*a*. The chemical cutting agent may be any chemical cutting agent known in the art that is operable to cause a reaction that severs the drilling member 220. The well shut-in device 210 then may then release a sealing agent to provide a barrier in the shut-in passageway 210*a* and the casing passageway substantially as described above, blocking upward migration of fluid in the wellbore below the shut-in device 210. In another embodiment, a chemical cutting agent may be used to sever the drilling member 220, while a mechanical device (e.g., a packer) may be used to provide a barrier in the shut in passageway 210*a* to block upward migration of fluid in the wellbore below the shut-in device. In an embodiment, chemical cutting may require grabbing and stopping the casing from moving before the chemical cutting agent in released into the shut-in passageway 210*a*.

Figure 8:
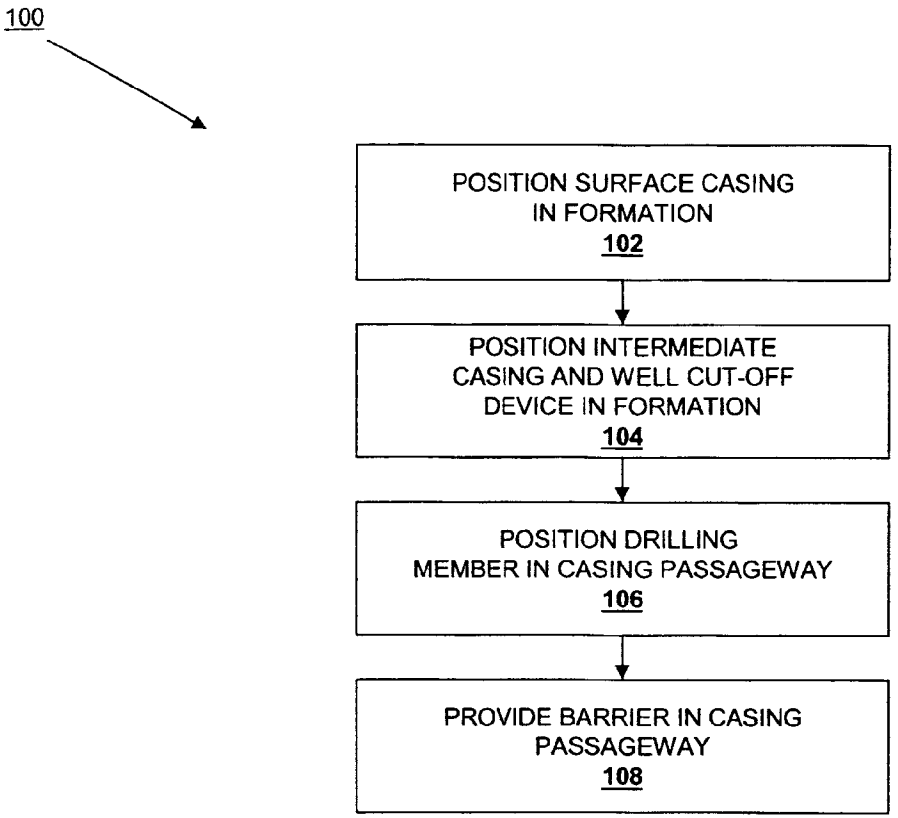
FIG. 8 is a flow chart illustrating an embodiment of a method for shutting in a well during a drilling phase of oilfield operations.

With reference to FIG. 8, operation of the sub-surface shut-in system of the present disclosure will now be described. The method 100 begins at block 102 where a surface casing is positioned in a formation. The method 100 then proceeds to block 104 where an intermediate casing and a shut-in device are positioned in the formation. At block 104 of the method 100, the drilling continues, extending the wellbore further into formation 200 and positioning an intermediate casing 206 in the first casing passageway 204*a* and cementing the intermediate casing 206 in the wellbore. Preferably, the intermediate casing 206 is positioned in the first portion 200*a* of the formation 200 that does not include a pressurized target fluid. However, the particular positioning of any of the casings described herein should not be construed as a limitation since it is the use of a sub-surface shut-in device as described herein that forms part of the novelty of the present disclosure. Likewise, the particular positioning of the sub-surface shut-in device in a particular section of casing should not be construed as a limitation, and those skilled in the art will understand that the location of the shut-in device of the present disclosure in a particular section of casing will be dependent on the characteristics of the particular well being drilled. For example, after setting a surface casing, a smaller hole may be drilled depending on the location and purpose of the well, and the sub-surface safety system would then be installed in a profile at or near the end of the surface casing.

The method 100 then proceeds to block 106 where a drilling member is positioned in a casing passageway. Subsequent to the positioning of the well cut-off device 210 in the intermediate casing 206, drilling and casing the wellbore continues to a desired depth. Surface and above surface BOPs, such as BOP 218 may be positioned in a manner well known in the art.

The method 100 then proceeds to block 106 where a drilling member is positioned in a casing passageway. Subsequent to the positioning of the well cut-off device 210 in the intermediate casing 206, drilling and casing the wellbore continues to a desired depth. Surface and above surface BOPs, such as BOP 218 may be positioned in a manner well known in the art. The method 100 then proceeds to block 108 where the drill string is severed and a barrier is provided in the casing passageway. In an embodiment, block 108 of the method 100 may be performed at any time after the well shut-in device 210 is positioned in intermediate casing 206 (e.g. before, during, or after drilling into the second portion 200*b* of the formation 200 using the drilling member 220.)

In step 106, one or more control systems for the wellbore as well as the electrical system for the drilling operations may monitor and a positive force may be applied to shut-in device to maintain the shearing rams in a retracted or "open" position so as to permit operation of the drill string. A predetermined series of events may be programmed into the control system to actuate the control systems in the event of the occurrence of certain conditions. For example, the monitoring system 224 may not actuate the shut-in device 210 unless each of the first control system 222*a* and the second control system 222*b* has been actuated and a loss of certain electrical functions for the drilling operation is detected. Redundancy may also be maintained to ensure that the shut-in device is not unnecessarily activated.

Upon activation, the shearing members are caused to sever the drilling member 220 and close off shut-in passageway 210*a*, blocking upward migration of formation fluids through the wellbore below the shut-in device.

While certain features and embodiments of the present disclosure have been described in detail herein, it will be readily understood that the present disclosure encompasses all modifications and enhancements within the scope and spirit of the following claims. Furthermore, no limitations are intended in the details of construction or design herein shown, other than as described in the claims below. Moreover, those skilled in the art will appreciate that description of various components as being oriented vertically or horizontally are not intended as limitations, but are provided for the convenience of describing the present disclosure

What is claimed is:

1. A sub-surface safety system for oil and gas wellbores, the system comprising:

at least one casing cemented within the wellbore, the casing defining a casing passageway therein;

a well shut-in device disposed in the casing passageway, the shut in device defining a shut-in device passageway and comprising a mechanism for severing a pipe string disposed in the shut-in device passageway and a mechanism for blocking fluid flow through the shut-in device passageway; and an actuator coupled to the well shut-in device and located outside the wellbore, wherein the actuator is operable to actuate the mechanism for severing and the mechanism for blocking;

wherein the actuator is operable to provide a positive pressure to the well shut-in device so as to maintain the mechanism for severing in a first position and the casing passageway adjacent the well shut-in device remains open; and wherein the actuator is a redundant system comprising:

a monitoring system communicably coupled to the shut-in device;

a control system communicably coupled to the monitoring system; and an electrical system communicably coupled to the monitoring system, wherein the monitoring, control and electrical systems must all be activated in order to activate the shut-in device.

2. The system of claim 1, wherein the mechanism for severing includes a shear ram having at least one shearing member that is operable between a first position in which the shearing member is substantially withdrawn from the shut-in device passageway and a second position in which the shearing member substantially blocks the shut-in device passageway impeding fluid flow therethrough.

3. The system of claim 2, wherein the casing is disposed along a longitudinal axis and the at least one shearing member is disposed along a shearing member axis, wherein the at least one shearing member is positioned in the casing at an angle relative to a longitudinal axis of the casing.

4. The system of claim 1, wherein the mechanism for severing comprises a plurality of shearing members, each of which is pivotally secured within the casing such that the shearing members pivot along a longitudinal axis of the casing, the shearing members being movable between a first position in which the shearing members are substantially withdrawn from the shut-in device passageway and a second position in which the shearing members substantially blocks the shut-in device passageway impeding fluid flow therethrough.

5. The system of claim 1, wherein the mechanism for severing is a chemical cutting agent and the mechanism for blocking is a sealing agent disposed to creating a barrier within the shut-in device passageway of the casing.

6. The system of claim 1, wherein the casing includes a support disposed in the casing passageway of the casing and on which the well shut-in device is mounted.

7. A sub-surface safety system for oil and gas wellbores, the system comprising:

a surface casing cemented in the wellbore and extending into a formation from a surface of the formation, the surface casing having a first end adjacent the surface and a second end;

a production casing having a first end and a second end and cemented in the wellbore;

an intermediate casing cemented in the wellbore between the surface casing and the production casing, wherein at least one of the surface casing, the intermediate casing, and the production casing defines a continuous casing passageway that extends from the surface and into the formation; and a well shut-in device disposed in the intermediate casing, wherein the well shut-in device defines a shut-in device passageway and is positioned below the first end of the surface casing, the well shut in device comprising at least one shearing member disposed to shear a pipe string adjacent the well shut-in device, the shearing member movable between a first position in which the shearing member is substantially withdrawn from the shut-in device passageway and a second position in which the shearing member substantially blocks the shut-in device passageway to impede fluid flow therethrough.

8. The system of claim 7, further comprising:

an actuator coupled to the well shut-in device and that located outside the wellbore, wherein the actuator is operable to actuate the shearing member of the well shut-in device.

9. The system of claim 8, wherein the actuator is operable to provide a positive pressure to the well shut-in device so as to maintain the shearing member in the first position.

10. The system of claim 7, wherein the well shut-in device includes a shear ram on which the at least one shearing member is mounted.

11. The system of claim 10, wherein the intermediate casing is disposed along a longitudinal axis and the shear ram member is positioned in the intermediate casing so as to form an angle between the longitudinal axis of the intermediate casing and the shear ram axis.

12. The system of claim 11, wherein the angle is greater than zero degrees and less than ninety degrees.

13. The system of claim 7, wherein the well shut-in device includes a plurality of shearing members, each of which is pivotally secured within the casing and movable between a first position in which the shearing members are substantially withdrawn from the shut-in device passageway and a second position in which the shearing members substantially blocks the shut-in device passageway impeding fluid flow therethrough.

14. The system of claim 7, comprising a pipe string disposed in the casing passageway adjacent the well shut-in device and a blow out preventer positioned above the top of the wellbore and through which the pipe string passes.

15. A method for shutting in a well during a well drilling operations, comprising:

cementing at least one casing in a wellbore extending into a formation from a surface of the formation, the wellbore having a first end adjacent the surface and a second end, the casing defining a casing passageway;

positioning a well shut-in device within the casing passageway, the well shut-in device defining a shut-in device passageway;

positioning a pipe string in the casing passageway so as to pass adjacent the well shut-in device;

utilizing the pipe string to drill the wellbore;

monitoring the wellbore;

wherein the well shut-in device is disposed, based upon monitoring of the wellbore, to sever the pipe string upon the occurrence of a predetermined event and to form a barrier in the shut-in device passageway, so as to block fluid flow through the shut-in device passageway adjacent the well shut-in device.

16. The method of claim 15, further comprising:

providing a positive pressure to the well shut-in device to maintain at least one shearing member in a first position in which the shearing member is substantially withdrawn from the shut-in device passageway, the shearing member movable to a second position upon release of the positive pressure in which the shearing members substantially blocks the shut-in device passageway impeding fluid flow therethrough.

17. The method of claim 15, wherein positioning the well shut-in device within the casing passageway of the casing, below the surface of the formation, comprises:

disposing at least one shear ram having a shear ram axis in the casing passageway so that the shear ram axis forms an angle with the longitudinal axis of the casing, thereby forming an angle between the shear ram axis and the casing longitudinal axis, wherein the angle is greater than zero degrees and less than ninety degrees.

18. The method of claim 15, further comprising:

actuating the well-shut in device to introducing a chemical agent into the casing passageway and to cut a drilling member located in the shut-in device passageway.

19. The method of claim 15, further comprising securing the well shut-in device to the casing.

20. The method of claim 15, wherein the well shut-in device is activated by a redundant actuator.

21. A sub-surface safety system for oil and gas wellbores, the system comprising:

at least one casing cemented within the wellbore, the casing defining a casing passageway therein; and a well shut-in device disposed in the casing passageway, the shut in device defining a shut-in device passageway and comprising a mechanism for severing a pipe string disposed in the shut-in device passageway and a mechanism for blocking fluid flow through the shut-in device passageway, wherein the mechanism for severing comprises a shear ram having at least one shearing member that is operable between a first position in which the shearing member is substantially withdrawn from the shut-in device passageway and a second position in which the shearing member substantially blocks the shut-in device passageway impeding fluid flow therethrough, and wherein the casing is disposed along a longitudinal axis and the at least one shearing member is disposed along a shearing member axis, wherein the shearing member axis is positioned at a non-perpendicular angle relative to a longitudinal axis of the casing.

22. A sub-surface safety system for oil and gas wellbores, the system comprising:

at least one casing cemented within the wellbore, the casing defining a casing passageway therein; and a well shut-in device disposed in the casing passageway, the shut in device defining a shut-in device passageway and comprising a mechanism for severing a pipe string disposed in the shut-in device passageway and a mechanism for blocking fluid flow through the shut-in device passageway, wherein the mechanism for severing comprises a plurality of shearing members, each of which is pivotally secured within the casing such that the shearing members pivot along a longitudinal axis of the casing, the shearing members being movable between a first position in which the shearing members are substantially withdrawn from the shut-in device passageway and a second position in which the shearing members substantially blocks the shut-in device passageway impeding fluid flow therethrough.

23. A sub-surface safety system for oil and gas wellbores, the system comprising:

at least one casing cemented within the wellbore, the casing defining a casing passageway therein; and a well shut-in device disposed in the casing passageway, the shut in device defining a shut-in device passageway and comprising a mechanism for severing a pipe string disposed in the shut-in device passageway and a mechanism for blocking fluid flow through the shut-in device passageway, wherein the mechanism for severing is a chemical cutting agent and the mechanism for blocking is a sealing agent disposed to creating a barrier within the casing passageway of the casing.

24. A sub-surface safety system for oil and gas wellbores, the system comprising:

at least one casing cemented within the wellbore, the casing defining a casing passageway therein; and a well shut-in device disposed in the casing passageway, the shut in device defining a shut-in device passageway and comprising a mechanism for severing a pipe string disposed in the shut-in device passageway and a mechanism for blocking fluid flow through the shut-in device passageway, wherein the casing includes a support disposed in the casing passageway of the casing and on which the well shut-in device is mounted.

* * * * *